US005214310A

United States Patent [19]

Adams

[11] Patent Number: 5,214,310

[45] Date of Patent: May 25, 1993

[54] TIMING MECHANISM WITH A PTC THERMISTOR

[75] Inventor: George W. Adams, Greenwood, Ind.

[73] Assignee: Emerson Electric Co., St. Louis, Mo.

[21] Appl. No.: 870,511

[22] Filed: Mar. 30, 1992

Related U.S. Application Data

[62] Division of Ser. No. 619,403, Nov. 29, 1990, Pat. No. 5,138,120.

[51] Int. Cl.[5] ..... H01H 7/00; H01H 43/00

[52] U.S. Cl. ..... 307/141

[58] Field of Search ..... 200/38 R, 38 B, 38 C; 361/165; 307/141

[56] References Cited

U.S. PATENT DOCUMENTS

| | | | |
|---|---|---|---|
| 1,927,512 | 9/1933 | Baloun | 361/165 |
| 2,123,063 | 7/1938 | Peters | 361/165 |
| 2,340,502 | 2/1944 | Baker | 340/328 |
| 2,482,820 | 9/1949 | Wolfson et al. | 307/132 R |
| 3,229,380 | 1/1966 | Worst | 34/45 |
| 3,331,139 | 7/1967 | Finnegan et al. | 34/45 |
| 3,434,089 | 3/1969 | Waseleski, Jr. et al. | 337/40 |
| 3,819,886 | 6/1974 | Homan et al. | 337/79 |
| 3,840,834 | 10/1974 | Obenhaus et al. | 200/38 B |
| 3,943,375 | 3/1976 | Williamson | 307/141 |
| 4,161,679 | 7/1979 | Kohn et al. | 200/38 B X |
| 4,292,482 | 9/1981 | Smock et al. | 200/38 R |
| 4,375,587 | 3/1983 | Perl | 219/10.55 B |
| 4,444,160 | 4/1984 | Steele | 123/179.21 |
| 4,724,504 | 2/1988 | Prouty | 361/165 |
| 4,918,404 | 4/1990 | Vitiello et al. | 331/11 |
| 4,924,204 | 5/1990 | Uchida | 338/22 R |

*Primary Examiner*—J. R. Scott

*Attorney, Agent, or Firm*—Robert F. Meyer; Eric R. Waldkoetter

[57] ABSTRACT

A timing mechanism has cams operating switches which control the functions of an appliance and another cam operating another switch supplying short pulses to a separate function such as a warning buzzer. A PTC thermistor is in series with the switch supplying the short pulses which when applied to the buzzer electrical circuit provides a short controlled "on" time to the buzzer even though power is applied to the complete switching system for an extended period of time by the timing mechanism.

4 Claims, 2 Drawing Sheets

TIMING MECHANISM WITH A PTC THERMISTOR

This application is a division of application Ser. No. 07/619,403, filed Nov. 29, 1990, now U.S. Pat. No. 5,138,120.

BACKGROUND OF THE INVENTION

The present invention relates to a timing mechanism and more particularly to a timing mechanism wherein a short controlled "on" time is applied to a circuit load even though power is electrically applied to the timing mechanism switching system for an extended period of time by the timing mechanism.

Most domestic electric and gas dryer appliances use a buzzer or alarm device to signal the consumer that the end of the drying program is complete. This signal is provided by the coast down time of the main appliance motor centrifugal switch which only continues for approximately one (1) second or less. It has been found that if clothes are not immediately removed from the dryer, wrinkles may set in the fabric, which in the case of many washables, is very undesirable. Therefore, most customers want a longer signal time (5–20 seconds) to make sure the housewife really hears the completed drying cycle signal. This short time signal is impossible to achieve from the main timing mechanism cam which usually has a speed of rotation of approximately 1½–2 degrees per minute.

The present invention, therefore, is directed to a timing mechanism which when electrically connected to a buzzer operates the buzzer in short pulses.

SUMMARY OF THE INVENTION

Accordingly there is provided a timing mechanism which in general comprises first cam means rotatably driven by a motor drive means, first electrical switch means responsive to the first cam means to be opened and closed in accordance with a first program of the first cam means, and means providing a second program of switching pulses comprising second cam means rotatably driven by the motor drive means, second switch means responsive to the second cam means, and a PTC thermistor circuit connected in series to the second switch means.

DETAILED DESCRIPTION OF THE INVENTION

Figure 1:
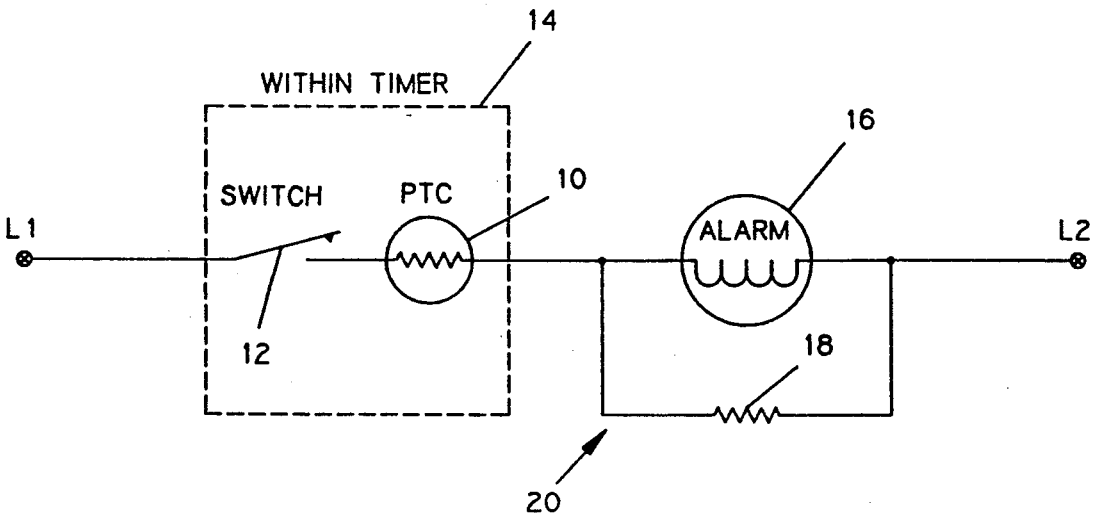
FIG. 1 is a schematic showing the principles of the invention.

Referring now to FIG. 1, in accordance with the present invention, a Positive Temperature Coefficient (PTC) thermistor 10 is put in series with a switch 12 of a timing mechanism 14, the PTC thermistor in turn being connected in series to an alarm 16. As shown a resistor 18 is connected in parallel with alarm 16 to provide a bleeding resistor network 20. Using a clothes dryer as an example, at the end of the dryer drying cycle, switch 12 closes to make electrical contact with the PTC thermistor which has a resistance of approximately 300 ohms. This electrical connection energizes alarm 16 and bleeding resistor network 20 having a resistance of approximately 1200 ohms. The alarm immediately sounds. The current drawn by the alarm and bleeding resistor network causes the PTC thermistor to heat internally. When the internal temperature of the PTC thermistor reaches the Curie point or the switching point of the PTC thermistor material, an abrupt change in resistance occurs which shifts the PTC thermistor from 300 ohms to approximately 156,000 ohms. Because of the high resistance of the PTC thermistor most of the voltage potential across it drops and limits current flow to bleeding resistor network 20. This causes the alarm to stop making noise even though electrical power is still applied to the alarm circuit through the timing mechanism. By changing the value of resistor 18, the "on" time of the alarm can be changed. For example if a higher value resistor is used, the value of resistor network 20 is raised and the alarm will have a longer "on" time.

Figure 2:
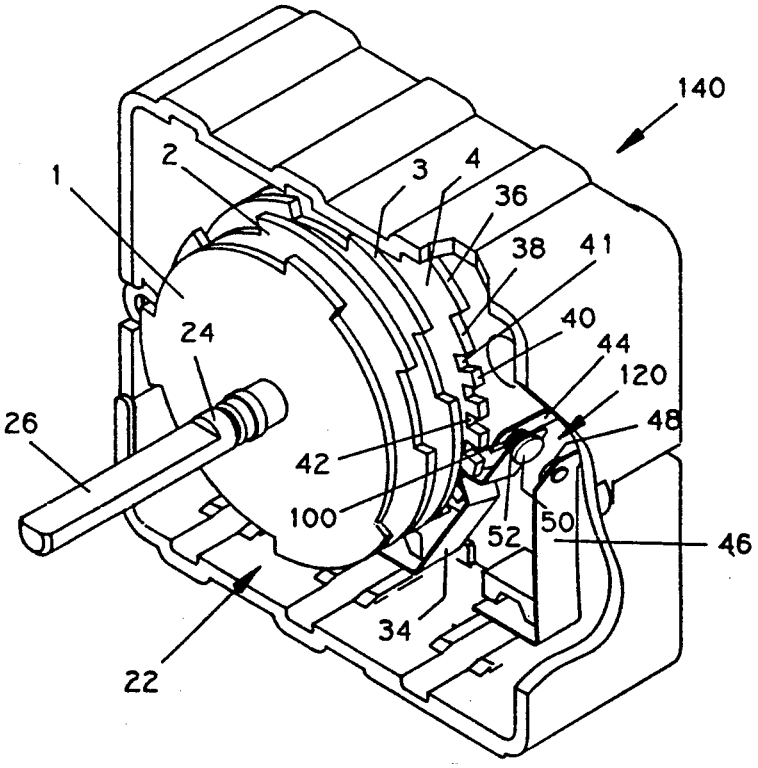
FIG. 2 is a view of a timing mechanism employing the invention.
Figure 3:
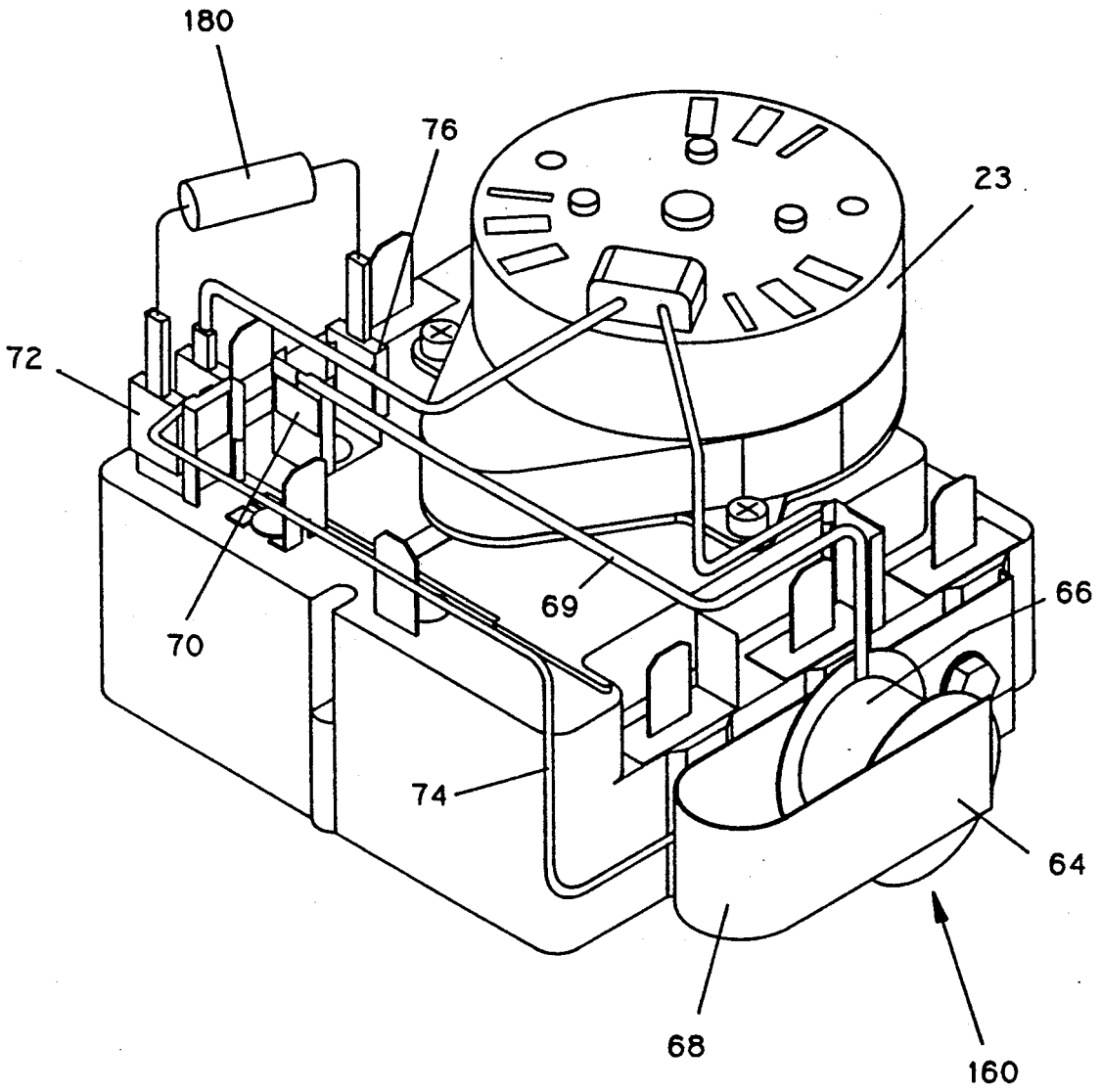
FIG. 3 is a top view of the timing mechanism of FIG. 2.

Referring now to FIGS. 2 and 3 there is shown a timing mechanism 140 employing the features of the invention. Timing mechanism 140 includes a cam means 22 that is fixedly carried on shaft 24 that is rotatably driven by a motor 23 through a clutch (not shown) in a manner well known in the art. The cam means can be manually set by a knob (not shown) carried on the double D portion 26 of the shaft. Cam means 22 includes a first set of cams 1, 2, and 3 which open and close switches, which for the purpose of clarity are not shown. These cams and switches control the functions of an appliance, independent of the alarm, which in the illustrative embodiment is a clothes dryer.

Cam 4 includes an outer cam profile 36, a middle or neutral cam profile 38, and a series of narrow lobes 40 which form a series of notches 41 the bases of which form an inner cam profile 42. Lobes 40 make up about one fourth the circumference of cam 4. Collectively the three cam profiles bias a double throw switch 120. Switch 120 includes a cam follower 34 and fixed electrical contact blades 44 and 46. Fixed contact blade 46 carries an electrical contact 48 while cam follower 34 carries electrical contacts 50 and 52. Fixed contact blade 44 carries a PTC thermistor 100. Thus the combination of contact 52 and PTC thermistor 100 constitute the series connection of switch 12 and PTC thermistor 10 shown and described in FIG. 1.

With particular reference to FIG. 3, there is shown an alarm means 160 and a resistor 180 carried by the timing mechanism and which are schematically illustrated in FIG. 1 as alarm 16 and resistor 18. Alarm means 160 includes a buzzer 64 having a coil 66 which when energized by an AC current causes an armature 68 to vibrate to produce a buzzing sound. One side of the alarm is connected to electrical terminal 70 through lead wire 69. Terminal 70 is connected to fixed electrical contact blade 44 which carries the PTC thermistor 100 (FIG. 2) while the other side is connected to terminal 72 of an AC power source (not shown). Resistor 180 is connected in parallel with buzzer 64 on one side through electrical terminal 72 and lead wire 74 and on the other side through electrical terminal 76 which is integral with electrical terminal 70.

In operation, cams 1, 2, and 3 upon rotation control the function of the appliance. When cam follower 34 engages upper cam profile 36 of cam 4, electrical contacts 48 and 50 close to control another appliance function when the cam follower 34 engages cam profile 38, switch 120 is completely opened. When cam follower 34 engages inner cam profile 42, electrical contact 52 closes with PTC thermistor 100 (FIG. 2) to operate buzzer 64. Cam follower 34 will remain on the inner cam profile of one of the notches 42 for 2 to 3 minutes during which time buzzer 64 will operate in the manner previously described with reference to FIG. 1 to provide a series of switching pulses thus causing the buzzer to turn off and on.

What is claimed is:

1. A method for controlling a load in an appliance to indicate end of an appliance function cycle, comprising the steps of:

(a) controlling the appliance function cycle with a first cam means and first switch means responsive to said first cam means;

(b) controlling application of power to a PTC thermistor with a second cam means and second switch means responsive to said second cam means;

(c) providing said PTC thermistor connected in a series circuit with said second switch means, the load and a bleeding resistor connected in parallel with the load;

(d) adjusting current flow through said PTC thermistor and thereby the time required for said PTC thermistor to internally heat and reach an abrupt increase in resistance with said bleeding resistor;

(e) switching power "off" to the load by said PTC thermistor abruptly increasing resistance as a result of internal heating caused by current flow through said PTC thermistor to the load and said bleeding resistor; and, (f) switching power "on" to the load by said PTC thermistor abruptly decreasing resistance as a result of internal cooling caused by decreasing current flow through said PTC thermistor to the load and said bleeding resistor.

2. The method recited in claim 1 wherein said load is an alarm.

3. The method recited in claim 1 wherein said PTC thermistor is carried on a contact blade on said second switch means.

4. The method recited in claim 1 wherein said second cam means and said second switch means control a second appliance function cycle in addition to controlling application of power to said PTC thermistor.

* * * * *